US011193729B2

(12) United States Patent
Chen

(10) Patent No.: US 11,193,729 B2
(45) Date of Patent: Dec. 7, 2021

(54) TOY WATER GUN FOR WATER STREAMING AND SPRAYING

(71) Applicant: Bo Chen, Guangdong (CN)

(72) Inventor: Bo Chen, Guangdong (CN)

(73) Assignee: Shantou P&C Plastic Products Company Limited, Shantou (CN)

( * ) Notice: Subject to any disclaimer, the term of this patent is extended or adjusted under 35 U.S.C. 154(b) by 216 days.

(21) Appl. No.: 16/716,538

(22) Filed: Dec. 17, 2019

(65) Prior Publication Data

US 2021/0063110 A1 Mar. 4, 2021

(30) Foreign Application Priority Data

Aug. 30, 2019 (CN) ..... 201921431489.2

(51) Int. Cl.
*B05B 9/04* (2006.01)
*F41B 9/00* (2006.01)

(52) U.S. Cl.
CPC ..... *F41B 9/0075* (2013.01); *B05B 9/0413* (2013.01); *F41B 9/0037* (2013.01)

(58) Field of Classification Search
CPC ..... B05B 9/0413; F41B 9/0037; F41B 9/0075
USPC ..... 239/530
See application file for complete search history.

(56) References Cited

U.S. PATENT DOCUMENTS 2,589,977 A * 3/1952 Stelzer ..... F41B 9/0018 222/79
3,197,070 A * 7/1965 Pearl ..... B05B 9/0426 222/79
3,363,842 A * 1/1968 Burns ..... B05B 1/12 239/441
3,578,789 A * 5/1971 Ferri ..... F41B 9/0071 222/79
4,214,674 A * 7/1980 Jones ..... B05B 9/0816 124/31
5,305,919 A * 4/1994 Johnson ..... B05B 9/0426 222/396

* cited by examiner

*Primary Examiner* — Chee-Chong Lee
(74) *Attorney, Agent, or Firm* — Minder Law Group; Willy H. Wong

(57) ABSTRACT

A toy water gun for water streaming and spraying comprising a piston type water gun, a nozzle, an adjustment sleeve and a position adjustment mechanism. The water gun comprises a cylinder, a piston fitted in a cavity of the cylinder, a pump rod connected to the piston, a handle disposed on the pump rod, and a water duct mounted on and communicating with the cylinder. The nozzle is mounted on the water duct, rear and front ends of the nozzle are disposed with a water inlet and a water outlet respectively, and the water inlet communicates with the water duct. The adjustment sleeve is sleeved on the nozzle, an inner side wall of the adjustment sleeve makes sealing contact with an outer side wall of the nozzle, the adjustment sleeve is disposed with a sealing plate having a water jet hole located right in front of the water outlet.

8 Claims, 4 Drawing Sheets

TOY WATER GUN FOR WATER STREAMING AND SPRAYING

RELATED APPLICATIONS

This application claims benefit of Chinese Patent Application No. CN201921431489.2, filed Aug. 30, 2019.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention relates to the field of toys, and more particularly to a toy water gun for water streaming and spraying.

Related Art

Toy water gun is a kind of toy that children like. The existing toy water gun is basically divided into imitation type toy water gun and piston pull-type toy water gun. The piston pull-type toy water gun is simpler in structure and cheaper than the imitation type toy water gun, it is also not easy to damage, has a long service life and is widely popular among children and parents, and therefore the popularity rate is getting higher and higher.

One prior art discloses an improved structure of a toy water pump gun comprising a water gun cylinder with a water outlet, inside the cylinder is fitted with a piston connected with a push rod, and another end of the push rod is provided with a handle. The handle and the cylinder are respectively sleeved with a soft handle case and a cylinder sleeve, the handle case is provided with an inner flange, the cylinder sleeve is provided with an inner-flip snap ring, and the inner-flip snap ring is attached with a patch having a central through hole. When in use, hold the handle case of the handle of the water pump gun to drive the push rod to push the piston to press against a bottom of the cylinder to empty the air in the cylinder. Then dip the water outlet with the central through hole in water, and pull the handle outward to drive the push rod to move the piston outward from the bottom of the cylinder to suck the water into the cylinder. When the piston is pushed again, the water in the cylinder is ejected from the water outlet through the central through hole, and the greater a pushing pressure, the farther a range of the water jet. However, this kind of toy water pump gun has only the function of water streaming, that is, has only a single function, which is easy to make the player feel dull and boring, thereby reducing the fun and appeal of the toy water gun.

SUMMARY OF THE INVENTION

One technical problem can be solved by the present invention by providing a toy water gun for water streaming and spraying, the toy water gun for water streaming and spraying can be used for streaming and spraying water, and can be conveniently switched between the two usage modes. One technical solution adopted is as follows:

One embodiment of a toy water gun for water streaming and spraying comprising:

a piston type water gun, the water gun comprising a cylinder, a piston, a pump rod, a handle, and a water duct, the piston being snugly fitted in a cavity of the cylinder and dividing the cavity of the cylinder into a front cavity and a rear cavity, a front end of the pump rod being connected to the piston, the handle being disposed on a rear end of the pump rod, the water duct being mounted on the cylinder and disposed along front and rear directions, a rear end of the water duct communicating with the front cavity of the cylinder;

a nozzle, the nozzle being mounted on the water duct, a rear end of the nozzle being disposed with a water inlet, a front end of the nozzle being disposed with a water outlet, and the water inlet of the nozzle communicating with a front end of the water duct;

an adjustment sleeve, the adjustment sleeve being sleeved on an outer side of the nozzle, an inner side wall of the adjustment sleeve making sealing contact with an outer side wall of the nozzle, a front end of the adjustment sleeve being disposed with a sealing plate, a water jet hole being disposed on the sealing plate, the water jet hole being located right in front of the water outlet of the nozzle; and a position adjustment mechanism capable of adjusting a position of the adjustment sleeve along front and rear directions, the position adjustment mechanism being disposed between the adjustment sleeve and the cylinder.

When in use, first hold one embodiment of the cylinder and push the handle forward, push the piston to a position near a front end of the cylinder through the pump rod to remove the air from the front cavity of the cylinder. Then immerse the water jet hole on the adjustment sleeve in water, push the handle backward, the piston is then driven by the pump rod to move toward a rear end of the cylinder, and suction generated is used to draw the water through the water jet hole, the nozzle and the water duct sequentially into the front cavity of the cylinder. When the piston is pushed by the handle again, the water in the front cavity of the cylinder flows through the water duct into a cavity of the nozzle under action of the piston, and then flows out from the water outlet of the nozzle. The position adjustment mechanism is capable of adjusting a position of the adjustment sleeve along the front and rear directions, and switching between two positions, which are described as follows. When at a front position, an edge of the water outlet of the nozzle contacts and fits with a rear side of the sealing plate, and the water outlet of the nozzle communicates with the water jet hole on the sealing plate. When the piston is pushed by the handle again, water current flowing out from the water outlet of the nozzle is directly sprayed through the water jet hole on the sealing plate. Since a distance between the water outlet of the nozzle and the water jet hole is close, it can effectively increase a chance of collision between a water current and an inner wall of the water jet hole, so that the water current is ejected in all directions after exiting the water jet hole to achieve the spray effect. When at a rear position, the edge of the water outlet of the nozzle and the rear side of the sealing plate are separated, at this time, the water outlet of the nozzle communicates with the water jet hole through a cavity of the adjustment sleeve. When the piston is pushed by the handle again, water current flowing out from the water outlet of the nozzle first flows into the cavity of the adjustment sleeve, and then is ejected from the water jet hole, so that the ejected water current is columnar, and the water streaming effect is achieved. When the above-mentioned toy water gun for water streaming and spraying is used, a user only needs to adjust a position of the adjustment sleeve along the front and rear directions by the position adjustment mechanism, the toy water gun for water streaming and spraying can be switched between two usage modes of either streaming or spraying water, and the operation is simple and convenient, thereby enhancing the fun and appeal of the toy water gun.

In one embodiment, a sealing ring is fixedly mounted on the outer side wall of the nozzle, and the outer side wall of the nozzle makes sealing contact with the inner side wall of the adjustment sleeve through the sealing ring.

In one embodiment, the nozzle comprises an outer tube and an inner tube, the outer tube is mounted on the front end of the water duct, and a rear end of the outer tube communicates with the front end of the water duct. The inner tube is disposed in a cavity of the outer tube, a front end of the inner tube protrudes from a front end opening of the outer tube, and a cavity of the inner tube is provided with a partition plate. The partition plate and an inner wall of the front end of the inner tube together encircle to form an opened diversion groove, and a groove wall of the opened diversion groove is provided with at least one notch. An outer side surface of the inner tube is provided with a plurality of guide vanes arranged in a circumferential direction of the inner tube, and an outer edge of each of the guide vanes contacts and fits with an inner side surface of the outer tube. The water jet hole is located right in front of the opened diversion groove. In the above nozzle, a rear end opening of the outer tube constitutes the water inlet of the nozzle, and a groove opening of the opened diversion groove constitutes the water outlet of the nozzle. A space between the outer tube and the inner tube is partitioned by each of the guide vanes into a plurality of diversion cavities arranged along the circumferential direction of the inner tube, and each of the diversion cavities respectively communicates with a cavity of the opened diversion groove through the corresponding notch. When in use and the adjustment sleeve is at the front position, an edge of the groove opening of the opened diversion groove contacts and fits with the rear side of the sealing plate, water in the front cavity of the cylinder passes through the water duct and the rear end opening of the outer tube and flows into each of the diversion cavities under action of the piston, and then enters the opened diversion groove from the corresponding notches to form a plurality of water currents with different flow directions and then the water currents enter the water jet hole. Thereby further increasing a chance of collision between the water currents and the inner wall of the water jet hole, and causing the water currents from the water jet hole to be uniformly sprayed in all directions to make the spray effect more obvious. When the adjustment sleeve is at the rear position, the edge of the groove opening of the opened diversion groove is separated with the rear side of the sealing plate, water in the front cavity of the cylinder flows into each of the diversion cavities of the nozzle through the water duct under action of the piston, and then flows out from the front end of the outer tube or the groove opening of the opened diversion groove to form a plurality of water currents with different flow directions. The water currents first flow into the cavity of the adjustment sleeve and converge together in the adjustment sleeve, and then is ejected from the water jet hole, so that the ejected water current is columnar, and the water streaming effect is achieved.

In one embodiment, the position adjustment mechanism comprises an adjustment member, the adjustment member is mounted on the water duct, and the adjustment member is provided with a cylindrical retaining wall. The adjustment sleeve is located on an inner side of the cylindrical retaining wall, the cylindrical retaining wall is provided with at least one guide groove, and the guide groove has a positioning section and a guide transition section. The positioning section extends along a circumferential direction of the cylindrical retaining wall, the guide transition section gradually extends from front to rear toward the circumferential direction of the cylindrical retaining wall, and a rear end of the guide transition section is connected with one end of the positioning section. The adjustment sleeve is provided with at least one guide slider, a quantity of the guide slider is the same as that of the guide groove, each of the guide sliders corresponds to one of the guide grooves, and each of the guide sliders is located in the corresponding guide groove. When the toy water gun needs to perform the water spraying function, the guide slider is capable of moving along the guide groove on the adjustment member by rotating the adjustment sleeve, moving from the guide transition section to the positioning section of the guide groove. At this time, the adjustment sleeve reaches the rear position, so that the edge of the water outlet of the nozzle contacts and fits with the rear side of the sealing plate. When the toy water gun needs to perform the water streaming function, the guide slider is capable of moving from the positioning section to a front end of the guide transition section of the guide groove by rotating the adjustment sleeve in an opposite direction. At this time, the adjustment sleeve reaches the front position, so that the edge of the water outlet of the nozzle is separated from the rear side of the sealing plate.

In one embodiment, the adjustment member comprises a first adjustment block and a second adjustment block, the first adjustment block and the second adjustment block are respectively sleeved on the water duct. At least one first arcuate wall is disposed on the first adjustment block, at least one second arcuate wall is disposed on the second adjustment block, and each of the first arcuate walls and each of the second arcuate walls together encircle to form the cylindrical retaining wall of the adjustment member. The first arcuate wall is provided with a front guiding surface, the second arcuate wall is provided with a rear guiding surface, a quantity of the rear guiding surface is the same as that of the front guiding surface, and each of the rear guiding surfaces corresponds to one of the front guiding surfaces. The rear guiding surface is located behind the front guiding surface and both are opposite in positions, and the rear guiding surface and the front guiding surface together encircle to form the guide groove on the cylindrical retaining wall. The position adjustment mechanism further comprises a limiting block, at least two positioning posts, and at least two compression springs. Each of the positioning posts is disposed on the front end of the cylinder and parallel to the water duct. The limiting block is mounted on a front end of each of the positioning posts, the limiting block is disposed with a round mounting hole, and the adjustment sleeve is sleeved in the round mounting hole. The first adjustment block and the second adjustment block are located between the front end of the cylinder and the limiting block, the first adjustment block is provided with a first keyway matching with each of the positioning posts, and the second adjustment block is provided with a second keyway matching with each of the positioning posts. Each of the compression springs is disposed between the front end of the cylinder and the second adjustment block, a rear end of each of the compression springs is connected with the front end of the cylinder, and a front end of each of the compression springs is connected with or in close contact with the second adjustment block. With this structure, the first adjustment block and the second adjustment block are capable of moving back and forth between the front end of the cylinder and the limiting block along the water duct. Through the fit between the first keyways and the positioning posts, and between the second keyways and the positioning posts, the first arcuate wall and the second arcuate wall are limited in a radial direction, and movement of the first adjustment block and the second adjustment block along the water duct is more stable. Each of the compression springs is capable of exerting a certain acting force on the second adjustment block, so that the rear guiding surface on the second arcuate wall has a tendency to move toward the front guiding surface on the first arcuate wall. The adjustment sleeve is capable of rotating in the round mounting hole on the limiting block to drive the limiting block to move between the guide transition section and the positioning section of the guide groove. When the guide slider on the adjustment sleeve is at the front end of the guide transition section, the second adjustment block moves toward the first adjustment block under action of each of the compression springs, so that a spacing between the rear guiding surface and the front guiding surface is reduced to ensure that the guide slider on the adjustment sleeve is incapable of moving along the guide transition section to achieve positioning of the adjustment sleeve. When the guide slider on the adjustment sleeve is at the positioning section of the guide groove, the second adjustment block has a tendency to move toward the first adjustment block under action of each of the compression springs. The rear guiding surface presses the guide slider on the adjustment sleeve against the front guiding surface tightly to realize positioning of the adjustment sleeve.

In one embodiment, the position adjustment mechanism further comprises a rotary housing, the rotary housing is rotatably mounted on the front end of the cylinder, the adjustment sleeve is fixedly mounted on a front end portion of the rotary housing, and the water duct, the nozzle, the limiting block, the adjustment member, each of the positioning posts, and each of the compression springs are all located in the rotary housing. In this way, the adjustment sleeve is driven to rotate about its rotation axis by rotating the rotary housing to achieve adjusting a position of the adjustment sleeve along the front and rear directions, which makes the operation more convenient. The rotary housing is also capable of protecting the water duct, the nozzle, the limiting block, the adjustment member, the positioning posts and the compression springs, and making the toy water gun more aesthetic.

One embodiment of the toy water gun for water streaming and spraying of the present invention has two usage modes of either streaming or spraying water, and the user only needs to adjust a position of the adjustment sleeve along the front and rear directions by the position adjustment mechanism, the toy water gun for water streaming and spraying can be switched between two usage modes of either streaming or spraying water, and the operation is simple and convenient, thereby enhancing the fun and appeal of the toy water gun.

DETAILED DESCRIPTION OF THE INVENTION

The technical solutions of the present invention are further described below with reference to the specific embodiments of the present invention in conjunction with the accompanied drawings, but the present invention is not limited to these embodiments.

Figure 1:
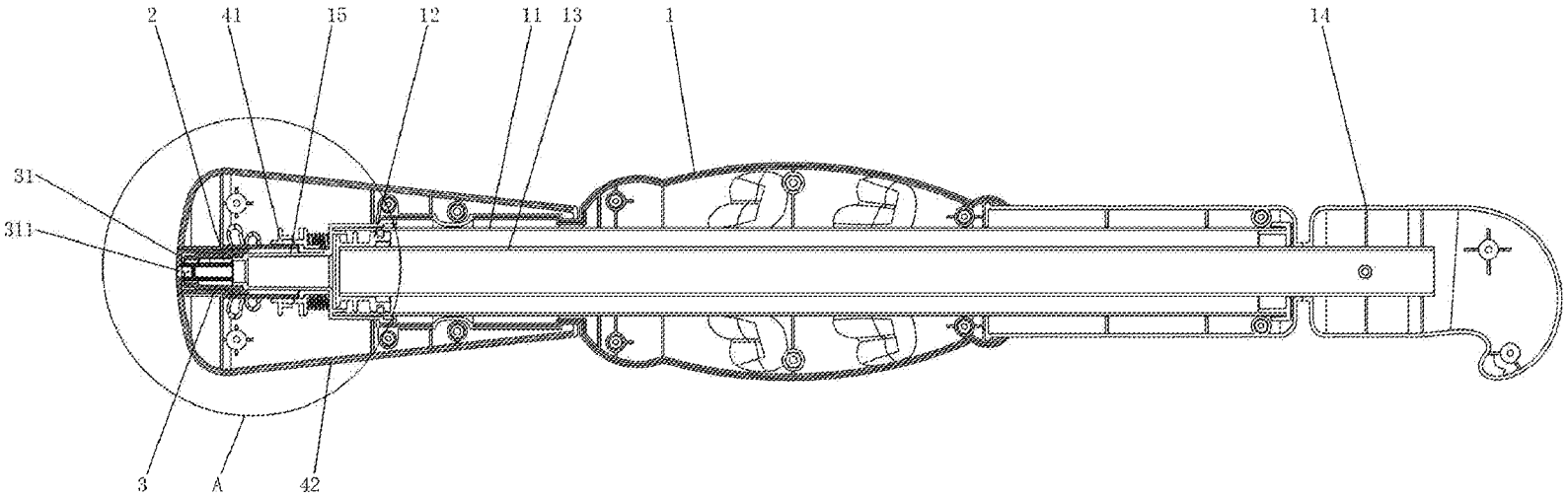
FIG. 1 is a schematic view of one embodiment of a toy water gun of the present invention when spraying is performed.
Figure 2:
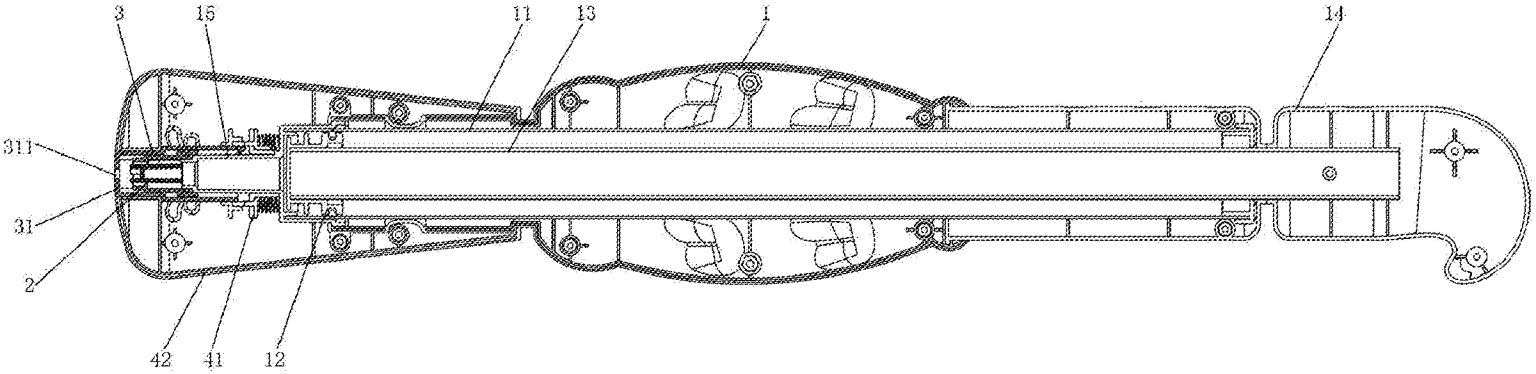
FIG. 2 is a schematic view of one embodiment of the toy water of the present invention when streaming is performed.
Figure 3:
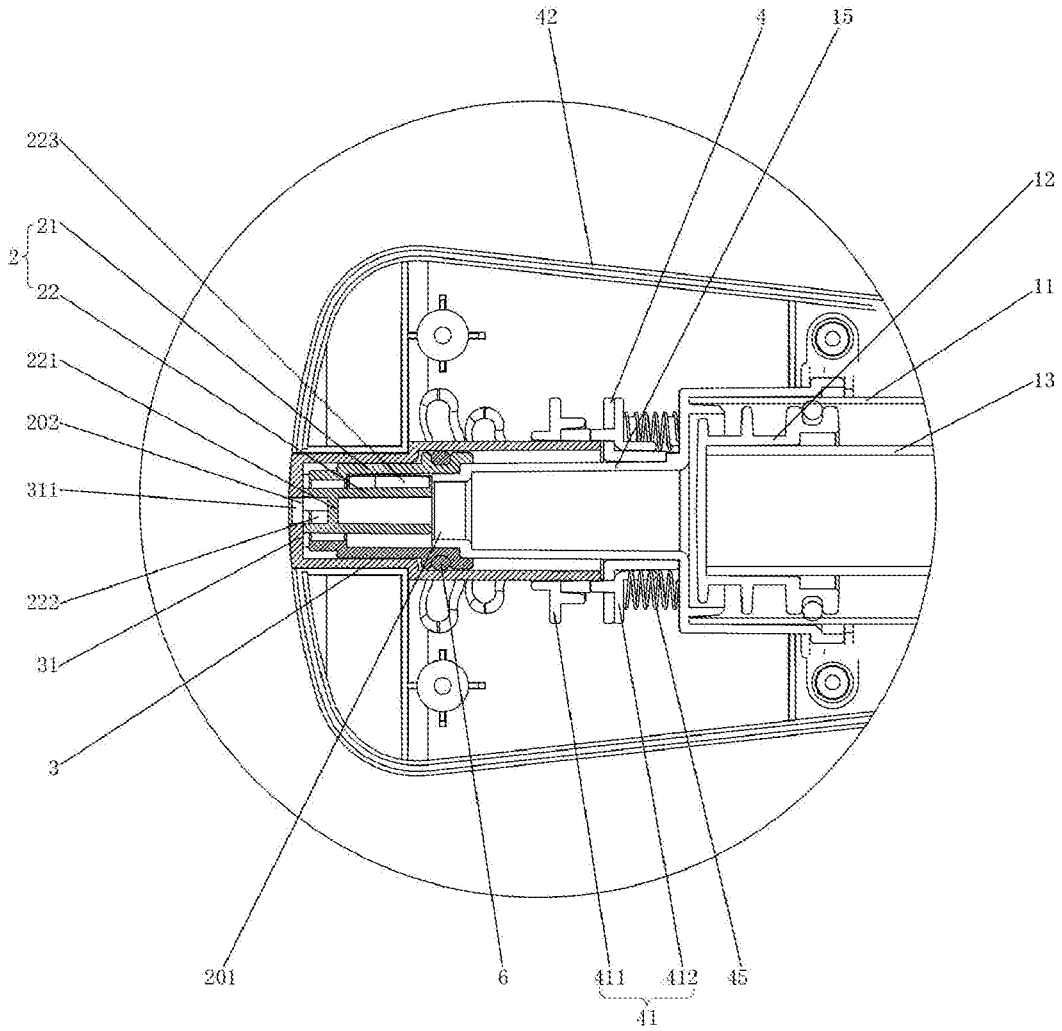
FIG. 3 is an enlarged view of portion A of FIG. 1.
Figure 4:
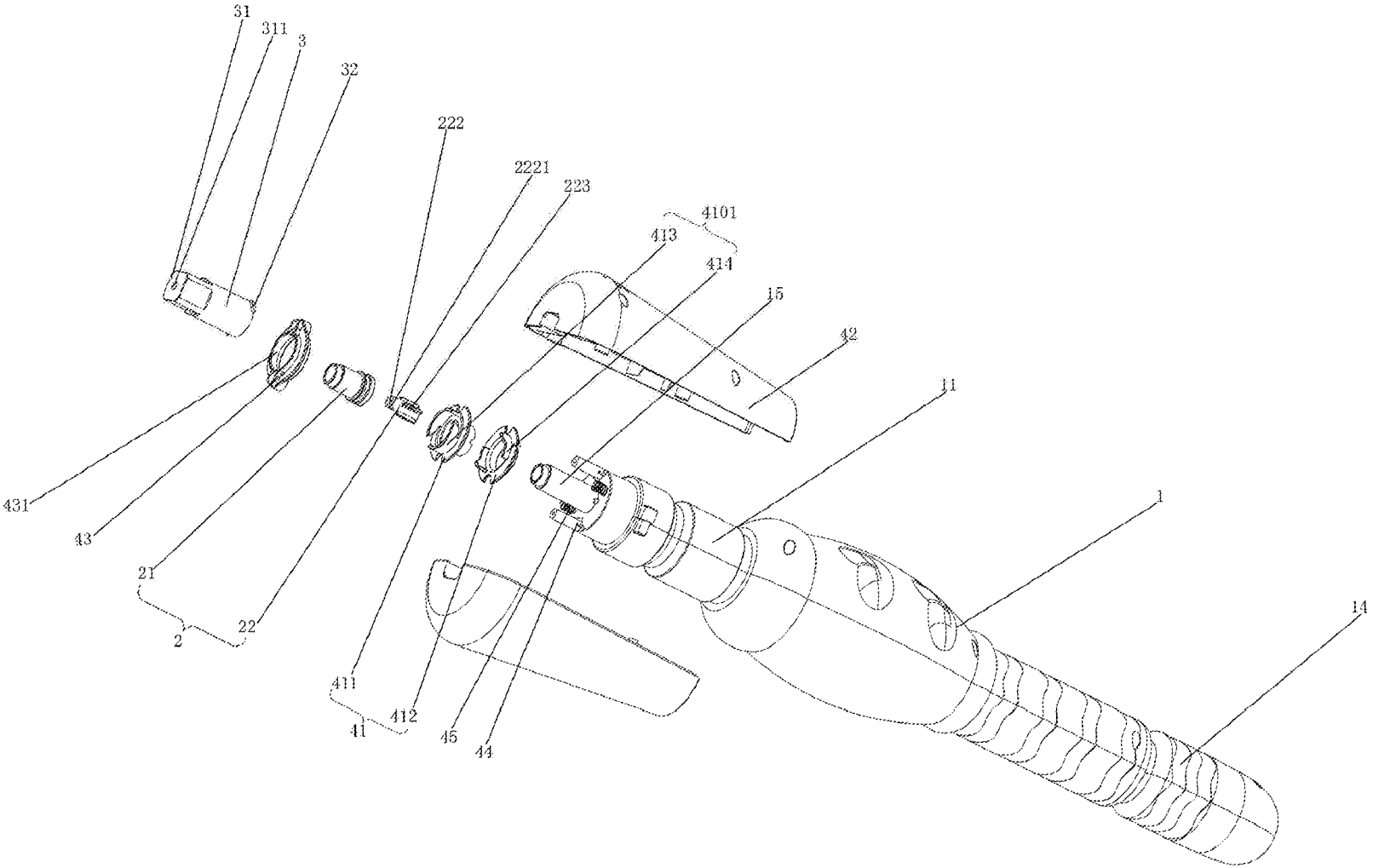
FIG. 4 is a perspective exploded view of one embodiment of the toy water gun shown in FIG. 1.
Figure 5:
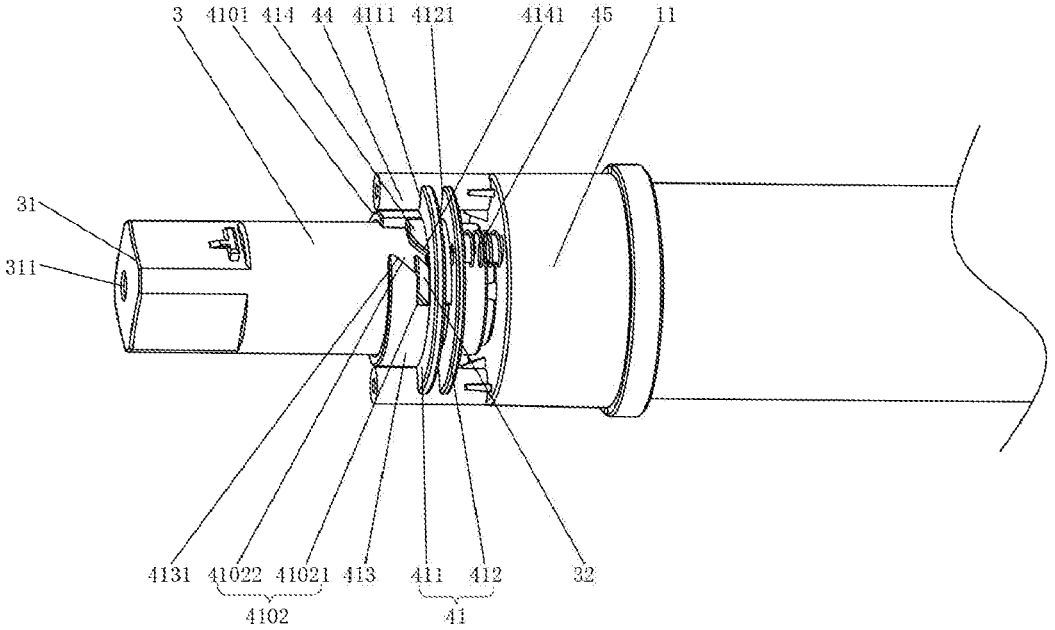
FIG. 5 is a schematic view of the connection and fitting of an adjustment member with a water gun and with an adjustment sleeve of one embodiment of the toy water gun shown in FIG. 1.

As shown in FIGS. 1 to 5, one embodiment of a toy water gun for water streaming and spraying includes a piston type water gun 1, a nozzle 2, an adjustment sleeve 3, and a position adjustment mechanism 4 capable of adjusting a position of the adjustment sleeve 3 along front and rear directions. The water gun 1 includes a cylinder 11, a piston 12, a pump rod 13, a handle 14, and a water duct 15. The piston 12 is snugly fitted in a cavity of the cylinder 11 and divides the cavity of the cylinder 11 into a front cavity and a rear cavity. A front end of the pump rod 13 is connected to the piston 12, and the handle 14 is disposed on a rear end of the pump rod 13. The water duct 15 is mounted on the cylinder 11 and disposed along front and rear directions, and a rear end of the water duct 15 communicates with the front cavity of the cylinder 11. The nozzle 2 is mounted on the water duct 15, a rear end of the nozzle 2 is disposed with a water inlet 201, a front end of the nozzle 2 is disposed with a water outlet 202, and the water inlet 201 of the nozzle 2 communicates with a front end of the water duct 15. The adjustment sleeve 3 is sleeved on an outer side of the nozzle 2, an inner side wall of the adjustment sleeve 3 makes sealing contact with an outer side wall of the nozzle 2, a front end of the adjustment sleeve 3 is disposed with a sealing plate 31, a water jet hole 311 is disposed on the sealing plate 31, and the water jet hole 311 is located right in front of the water outlet 202 of the nozzle 2. The position adjustment mechanism 4 is disposed between the adjustment sleeve 3 and the cylinder 11.

In one embodiment, a sealing ring 6 is fixedly mounted on the outer side wall of the nozzle 2, and the outer side wall of the nozzle 2 makes sealing contact with the inner side wall of the adjustment sleeve 3 through the sealing ring 6.

In one embodiment, the position adjustment mechanism 4 comprises an adjustment member 41, the adjustment member 41 is mounted on the water duct 15, the adjustment member 41 is provided with a cylindrical retaining wall 4101, and the adjustment sleeve 3 is located on an inner side of the cylindrical retaining wall 4101. The cylindrical retaining wall 4101 is provided with a plurality of guide grooves 4102, the guide groove 4102 has a positioning section 41021 and a guide transition section 41022, the positioning section 41021 extends along a circumferential direction of the cylindrical retaining wall 4101, the guide transition section 41022 gradually extends from front to rear toward the circumferential direction of the cylindrical retaining wall 4101, and a rear end of the guide transition section 41022 is connected with one end of the positioning section 41021. The adjustment sleeve 3 is provided with a plurality of guide sliders 32, a quantity of the guide sliders 32 is the same as that of the guide grooves 4102, each of the guide sliders 32 corresponds to one of the guide grooves 4102, and each of the guide sliders 32 is respectively located in the corresponding guide groove 4102.

In one embodiment, the adjustment member 41 comprises a first adjustment block 411 and a second adjustment block 412, and the first adjustment block 411 and the second adjustment block 412 are respectively sleeved on the water duct 15. A plurality of first arcuate walls 413 are disposed on the first adjustment block 411, a plurality of second arcuate walls 414 are disposed on the second adjustment block 412, and each of the first arcuate walls 413 and each of the second arcuate walls 414 together encircle to form the cylindrical retaining wall 4101 of the adjustment member 41. The first arcuate wall 413 is provided with a front guiding surface 4131, the second arcuate wall 414 is provided with a rear guiding surface 4141, a quantity of the rear guiding surfaces 4141 is the same as that of the front guiding surfaces 4131, and each of the rear guiding surfaces 4141 corresponds to one of the front guiding surfaces 4131. The rear guiding surface 4141 is located behind the front guiding surface 4131 and both are opposite in positions, and the rear guiding surface 4141 and the front guiding surface 4131 together encircle to form the guide groove 4102. The position adjustment mechanism 4 further comprises a rotary housing 42, a limiting block 43, two positioning posts 44, and two compression springs 45. Each of the positioning posts 44 is disposed on a front end of the cylinder 11 and parallel to the water duct 15. The limiting block 43 is mounted on a front end of each of the positioning posts 44, the limiting block 43 is disposed with a round mounting hole 431, and the adjustment sleeve 3 is sleeved in the round mounting hole 431. The first adjustment block 411 and the second adjustment block 412 are located between the front end of the cylinder 11 and the limiting block 43, the first adjustment block 411 is provided with a first keyway 4111 matching with each of the positioning posts 44, and the second adjustment block 412 is provided with a second keyway 4121 matching with each of the positioning posts 44. Each of the compression springs 45 is disposed between the front end of the cylinder 11 and the second adjustment block 412, a rear end of each of the compression springs 45 is connected with the front end of the cylinder 11, and a front end of each of the compression springs 45 is connected with or in close contact with the second adjustment block 412. The rotary housing 42 is rotatably mounted on the front end of the cylinder 11, the adjustment sleeve 3 is fixedly mounted on a front end portion of the rotary housing 42, and the water duct 15, the nozzle 2, the adjustment member 41, the limiting block 43, each of the positioning posts 44, and each of the compression springs 45 are all located in the rotary housing 42.

In one embodiment, the nozzle 2 comprises an outer tube 21 and an inner tube 22, the outer tube 21 is mounted on the front end of the water duct 15, a rear end of the outer tube 21 communicates with the front end of the water duct 15, and a rear end opening of the outer tube 21 constitutes the water inlet 201 of the nozzle 2. The inner tube 22 is disposed in a cavity of the outer tube 21, and a front end of the inner tube 22 protrudes from a front end opening of the outer tube 21. A cavity of the inner tube 22 is provided with a partition plate 221, the partition plate 221 and an inner wall of the front end of the inner tube 22 together encircle to form an opened diversion groove 222. A groove opening of the opened diversion groove 222 constitutes the water outlet 202 of the nozzle 2, and a groove wall of the opened diversion groove 222 is provided with a plurality of notches 2221. An outer side surface of the inner tube 22 is provided with a plurality of guide vanes 223 arranged in a circumferential direction of the inner tube 22, an outer edge of each of the guide vanes 223 contacts and fits with an inner side surface of the outer tube 21. A space between the outer tube 21 and the inner tube 22 is partitioned by each of the guide vanes 223 into a plurality of diversion cavities arranged along the circumferential direction of the inner tube 22, and each of the diversion cavities respectively communicates with a cavity of the opened diversion groove 222 through the corresponding notch 2221. The water jet hole 311 is located right in front of the opened diversion groove 222.

The following is a brief description of a method for using one embodiment of the toy water gun for water streaming and spraying:

When in use, first hold one embodiment of the cylinder 11 and push the handle 14 forward, push the piston 12 to a position near the front end of the cylinder 11 through the pump rod 13 to remove the air from the front cavity of the cylinder 11. Then immerse the water jet hole 311 on the adjustment sleeve 3 in water, push the handle 14 backward, the piston 12 is then driven by the pump rod 13 to move toward a rear end of the cylinder 11, and suction generated is used to draw the water through the water jet hole 311, the nozzle 2 and the water duct 15 sequentially into the front cavity of the cylinder 11. When the piston 12 is pushed by the handle 14 again, the water in the front cavity of the cylinder 11 flows through the water duct 15 into a cavity of the nozzle 2 under action of the piston 12, and finally flows out from the water jet hole 311. When the toy water gun needs to perform the water spraying function, the adjustment sleeve 3 is driven to rotate about its rotation axis by rotating the rotary housing 42, the guide slider 32 is caused to move along the guide groove 4102 on the adjustment member 41, moving from the guide transition section 41022 to the positioning section 41021 of the guide groove 4102. (At this time, the second adjustment block 412 moves toward the first adjustment block 411 under action of each of the compression springs 45, and the rear guiding surface 4141 presses the guide slider 32 on the adjustment sleeve 3 against the front guiding surface 4131 tightly to realize positioning of the guide slider 32.) The adjustment sleeve 3 is caused to reach the rear position, at this time, an edge of the groove opening of the opened diversion groove 222 contacts and fits with the rear side of the sealing plate 31. When the piston 12 is pushed by the handle 14 again, water in the front cavity of the cylinder 11 passes through the water duct 15 and the rear end opening of the outer tube 21 and flows into each of the diversion cavities under action of the piston 12, and then enters the opened diversion groove 222 from the corresponding notches 2221 to form a plurality of water currents with different flow directions which are directly sprayed through the water jet hole 311 on the sealing plate 31. Since a distance between the water outlet 202 of the nozzle 2 and the water jet hole 311 is close, and the flow directions of the water currents are different, a chance of collision between the water currents and the inner wall of the water jet hole 311 is effectively increased, so that the water currents are ejected in all directions after exiting the water jet hole 311 to achieve the spray effect. When the toy water gun needs to perform the water streaming function, the adjustment sleeve 3 is driven to rotate about its rotation axis in an opposite direction by rotating the rotary housing 42 in an opposite direction to cause the guide slider 32 to move along the guide groove 4102 on the adjustment member 41, moving from the positioning section 41021 to a front end of the guide transition section 41022 of the guide groove 4102. (At this time, the second adjustment block 412 moves toward the first adjustment block 411 under action of each of the compression springs 45, so that a spacing between the rear guiding surface 4141 and the front guiding surface 4131 is reduced to realize the guide slider 32 on the adjustment sleeve 3 being incapable of moving along the guide transition section 41022 to achieve positioning of the adjustment sleeve 3.) The adjustment sleeve 3 is caused to reach the front position, at this time, the edge of the groove opening of the opened diversion groove 222 is separated with the rear side of the sealing plate 31. When the piston 12 is pushed by the handle 14 again, water in the front cavity of the cylinder 11 passes through the water duct 15 and the rear end opening of the outer tube 21 and flows into each of the diversion cavities under action of the piston 12, and then enters the opened diversion groove 222 through the corresponding notches 2221 to form a plurality of water currents with different flow directions which are first converged into a cavity of the adjustment sleeve 3, and then ejected from the water jet hole 311, so that the ejected water current is columnar, and the water streaming effect is achieved.

The specific embodiments described herein are merely illustrative of the spirit of the present invention. Technical personnel skilled in the art to which the present invention pertains can make various modifications or additions to the specific embodiments described or replace them in a similar manner, without departing from the spirit of the present invention or beyond the scope defined by the appended claims.

LIST OF REFERENCED PARTS water gun 1
cylinder 11
piston 12
pump rod 13
handle 14
water duct 15
nozzle 2
water inlet 201
water outlet 202
outer tube 21
inner tube 22
partition plate 221
opened diversion groove 222
notch 2221
guide vane 223
adjustment sleeve 3
sealing plate 31
water jet hole 311
guide slider 32
position adjustment mechanism 4
adjustment member 41
cylindrical retaining wall 4101
guide groove 4102
positioning section 41021
guide transition section 41022
first adjustment block 411
first keyway 4111
second adjustment block 412
second keyway 4121
first arcuate wall 413
front guiding surface 4131
second arcuate wall 414
rear guiding surface 4141
rotary housing 42
limiting block 43
round mounting hole 431
positioning post 44
compression spring 45
sealing ring 6

What is claimed is:

1. A toy water gun for water streaming and spraying comprising:

a piston water gun, the water gun comprising a cylinder, a piston, a pump rod, a handle, and a water duct, the piston being snugly fitted in a cavity of the cylinder and dividing the cavity of the cylinder into a front cavity and a rear cavity, a front end of the pump rod being connected to the piston, the handle being disposed on a rear end of the pump rod, the water duct being mounted on the cylinder and disposed along front and rear directions, a rear end of the water duct communicating with the front cavity of the cylinder;

a nozzle, the nozzle being mounted on the water duct, a rear end of the nozzle being disposed with a water inlet, a front end of the nozzle being disposed with a water outlet, and the water inlet of the nozzle communicating with a front end of the water duct;

an adjustment sleeve, the adjustment sleeve being sleeved on an outer side wall of the nozzle, an inner side wall of the adjustment sleeve making sealing contact with the outer side wall of the nozzle, a front end of the adjustment sleeve being disposed with a sealing plate, a water jet hole being disposed on the sealing plate, the water jet hole being located directly in front of the water outlet of the nozzle; and a position adjustment mechanism capable of adjusting a position of the adjustment sleeve along the front and rear directions, the position adjustment mechanism being disposed between the adjustment sleeve and the cylinder;

wherein the nozzle comprises an outer tube and an inner tube, the outer tube is mounted on the front end of the water duct, a rear end of the outer tube communicates with the front end of the water duct, the inner tube is disposed in a cavity of the outer tube, and a front end of the inner tube protrudes from a front end opening of the outer tube, a cavity of the inner tube is provided with a partition plate, the partition plate and an inner wall of the front end of the inner tube together encircle to form an opened diversion groove, and a groove wall of the opened diversion groove is provided with at least one notch, an outer side surface of the inner tube is provided with a plurality of guide vanes arranged in a circumferential direction of the inner tube, an outer edge of each of the guide vanes contacts and fits with an inner side surface of the outer tube, and the water jet hole is located right in front of the opened diversion groove.

2. The toy water gun as claimed in claim 1, wherein the position adjustment mechanism comprises an adjustment member, the adjustment member is mounted on the water duct, the adjustment member is provided with a cylindrical retaining wall, the adjustment sleeve is located on an inner side of the cylindrical retaining wall, the cylindrical retaining wall is provided with at least one guide groove, the guide groove has a positioning section and a guide transition section, the positioning section extends along a circumferential direction of the cylindrical retaining wall, the guide transition section gradually extends from front to rear toward the circumferential direction of the cylindrical retaining wall, and a rear end of the guide transition section is connected with one end of the positioning section, the adjustment sleeve is provided with at least one guide slider, a quantity of the guide slider is the same as that of the guide groove, each of the guide sliders corresponds to one of the guide grooves, and each of the guide sliders is located in the corresponding guide groove.

3. The toy water gun as claimed in claim 2, wherein the adjustment member comprises a first adjustment block and a second adjustment block, the first adjustment block and the second adjustment block are respectively sleeved on the water duct, at least one first arcuate wall is disposed on the first adjustment block, at least one second arcuate wall is disposed on the second adjustment block, each of the first arcuate walls and each of the second arcuate walls together encircle to form the cylindrical retaining wall of the adjustment member, the first arcuate wall is provided with a front guiding surface, the second arcuate wall is provided with a rear guiding surface, a quantity of the rear guiding surface is the same as that of the front guiding surface, each of the rear guiding surfaces corresponds to one of the front guiding surfaces, the rear guiding surface is located behind the front guiding surface and both are opposite in positions, and the rear guiding surface and the front guiding surface together encircle to form the guide groove on the cylindrical retaining wall, the position adjustment mechanism further comprises a limiting block, at least two positioning posts, and at least two compression springs, each of the positioning posts is disposed on a front end of the cylinder and parallel to the water duct, the limiting block is mounted on a front end of each of the positioning posts, the limiting block is disposed with a round mounting hole, and the adjustment sleeve is sleeved in the round mounting hole, the first adjustment block and the second adjustment block are located between the front end of the cylinder and the limiting block, the first adjustment block is provided with a first keyway matching with each of the positioning posts, and the second adjustment block is provided with a second keyway matching with each of the positioning posts, each of the compression springs is disposed between the front end of the cylinder and the second adjustment block, a rear end of each of the compression springs is connected with the front end of the cylinder, and a front end of each of the compression springs is connected with or in close contact with the second adjustment block.

4. The toy water gun as claimed in claim 3, wherein the position adjustment mechanism further comprises a rotary housing, the rotary housing is rotatably mounted on the front end of the cylinder, the adjustment sleeve is fixedly mounted on a front end portion of the rotary housing, and the water duct, the nozzle, the limiting block, the adjustment member, each of the positioning posts, and each of the compression springs are all located in the rotary housing.

5. A toy water gun for water streaming and spraying comprising:

a piston water gun, the water gun comprising a cylinder, a piston, a pump rod, a handle, and a water duct, the piston being snugly fitted in a cavity of the cylinder and dividing the cavity of the cylinder into a front cavity and a rear cavity, a front end of the pump rod being connected to the piston, the handle being disposed on a rear end of the pump rod, the water duct being mounted on the cylinder and disposed along front and rear directions, a rear end of the water duct communicating with the front cavity of the cylinder;

a nozzle, the nozzle being mounted on the water duct, a rear end of the nozzle being disposed with a water inlet, a front end of the nozzle being disposed with a water outlet, and the water inlet of the nozzle communicating with a front end of the water duct;

an adjustment sleeve, the adjustment sleeve being sleeved on an outer side wall of the nozzle, an inner side wall of the adjustment sleeve making sealing contact with an outer side wall of the nozzle, a front end of the adjustment sleeve being disposed with a sealing plate, a water jet hole being disposed on the sealing plate, the water jet hole being located directly in front of the water outlet of the nozzle; and a position adjustment mechanism capable of adjusting a position of the adjustment sleeve along the front and rear directions, the position adjustment mechanism being disposed between the adjustment sleeve and the cylinder;

wherein the position adjustment mechanism comprises an adjustment member, the adjustment member is mounted on the water duct, the adjustment member is provided with a cylindrical retaining wall, the adjustment sleeve is located on an inner side of the cylindrical retaining wall, the cylindrical retaining wall is provided with at least one guide groove, the guide groove has a positioning section and a guide transition section, the positioning section extends along a circumferential direction of the cylindrical retaining wall, the guide transition section gradually extends from front to rear toward the circumferential direction of the cylindrical retaining wall, and a rear end of the guide transition section is connected with one end of the positioning section, the adjustment sleeve is provided with at least one guide slider, a quantity of the guide slider is the same as that of the guide groove, each of the guide sliders corresponds to one of the guide grooves, and each of the guide sliders is located in the corresponding guide groove; and wherein the adjustment member comprises a first adjustment block and a second adjustment block, the first adjustment block and the second adjustment block are respectively sleeved on the water duct, at least one first arcuate wall is disposed on the first adjustment block, at least one second arcuate wall is disposed on the second adjustment block, each of the first arcuate walls and each of the second arcuate walls together encircle to form the cylindrical retaining wall of the adjustment member, the first arcuate wall is provided with a front guiding surface, the second arcuate wall is provided with a rear guiding surface, a quantity of the rear guiding surface is the same as that of the front guiding surface, each of the rear guiding surfaces corresponds to one of the front guiding surfaces, the rear guiding surface is located behind the front guiding surface and both are opposite in positions, and the rear guiding surface and the front guiding surface together encircle to form the guide groove on the cylindrical retaining wall, the position adjustment mechanism further comprises a limiting block, at least two positioning posts, and at least two compression springs, each of the positioning posts is disposed on a front end of the cylinder and parallel to the water duct, the limiting block is mounted on a front end of each of the positioning posts, the limiting block is disposed with a round mounting hole, and the adjustment sleeve is sleeved in the round mounting hole, the first adjustment block and the second adjustment block are located between the front end of the cylinder and the limiting block, the first adjustment block is provided with a first keyway matching with each of the positioning posts, and the second adjustment block is provided with a second keyway matching with each of the positioning posts, each of the compression springs is disposed between the front end of the cylinder and the second adjustment block, a rear end of each of the compression springs is connected with the front end of the cylinder, and a front end of each of the compression springs is connected with or in close contact with the second adjustment block.

6. The toy water gun for water streaming and spraying as claimed in claim 5, wherein the position adjustment mechanism further comprises a rotary housing, the rotary housing is rotatably mounted on the front end of the cylinder, the adjustment sleeve is fixedly mounted on a front end portion of the rotary housing, and the water duct, the nozzle, the limiting block, the adjustment member, each of the positioning posts, and each of the compression springs are all located in the rotary housing.

7. A toy water gun for water streaming and spraying comprising:

a piston water gun, the water gun comprising a cylinder, a piston, a pump rod, a handle, and a water duct, the piston being snugly fitted in a cavity of the cylinder and dividing the cavity of the cylinder into a front cavity and a rear cavity, a front end of the pump rod being connected to the piston, the handle being disposed on a rear end of the pump rod, the water duct being mounted on the cylinder and disposed along front and rear directions, a rear end of the water duct communicating with the front cavity of the cylinder;

a nozzle, the nozzle being mounted on the water duct, a rear end of the nozzle being disposed with a water inlet, a front end of the nozzle being disposed with a water outlet, and the water inlet of the nozzle communicating with a front end of the water duct;

an adjustment sleeve, the adjustment sleeve being sleeved on an outer side wall of the nozzle, an inner side wall of the adjustment sleeve making sealing contact with an outer side wall of the nozzle, a front end of the adjustment sleeve being disposed with a sealing plate, a water jet hole being disposed on the sealing plate, the water jet hole being located directly in front of the water outlet of the nozzle; and a position adjustment mechanism capable of adjusting a position of the adjustment sleeve along the front and rear directions, the position adjustment mechanism being disposed between the adjustment sleeve and the cylinder;

wherein a sealing ring is fixedly mounted on the outer side wall of the nozzle, and the outer side wall of the nozzle makes sealing contact with the inner side wall of the adjustment sleeve through the sealing ring;

wherein the position adjustment mechanism comprises an adjustment member, the adjustment member is mounted on the water duct, the adjustment member is provided with a cylindrical retaining wall, the adjustment sleeve is located on an inner side of the cylindrical retaining wall, the cylindrical retaining wall is provided with at least one guide groove, the guide groove has a positioning section and a guide transition section, the positioning section extends along a circumferential direction of the cylindrical retaining wall, the guide transition section gradually extends from front to rear toward the circumferential direction of the cylindrical retaining wall, and a rear end of the guide transition section is connected with one end of the positioning section, the adjustment sleeve is provided with at least one guide slider, a quantity of the guide slider is the same as that of the guide groove, each of the guide sliders corresponds to one of the guide grooves, and each of the guide sliders is located in the corresponding guide groove; and wherein the adjustment member comprises a first adjustment block and a second adjustment block, the first adjustment block and the second adjustment block are respectively sleeved on the water duct, at least one first arcuate wall is disposed on the first adjustment block, at least one second arcuate wall is disposed on the second adjustment block, each of the first arcuate walls and each of the second arcuate walls together encircle to form the cylindrical retaining wall of the adjustment member, the first arcuate wall is provided with a front guiding surface, the second arcuate wall is provided with a rear guiding surface, a quantity of the rear guiding surface is the same as that of the front guiding surface, each of the rear guiding surfaces corresponds to one of the front guiding surfaces, the rear guiding surface is located behind the front guiding surface and both are opposite in positions, and the rear guiding surface and the front guiding surface together encircle to form the guide groove on the cylindrical retaining wall, the position adjustment mechanism further comprises a limiting block, at least two positioning posts, and at least two compression springs, each of the positioning posts is disposed on a front end of the cylinder and parallel to the water duct, the limiting block is mounted on a front end of each of the positioning posts, the limiting block is disposed with a round mounting hole, and the adjustment sleeve is sleeved in the round mounting hole, the first adjustment block and the second adjustment block are located between the front end of the cylinder and the limiting block, the first adjustment block is provided with a first keyway matching with each of the positioning posts, and the second adjustment block is provided with a second keyway matching with each of the positioning posts, each of the compression springs is disposed between the front end of the cylinder and the second adjustment block, a rear end of each of the compression springs is connected with the front end of the cylinder, and a front end of each of the compression springs is connected with or in close contact with the second adjustment block.

8. The toy water gun as claimed in claim 7, wherein the position adjustment mechanism further comprises a rotary housing, the rotary housing is rotatably mounted on the front end of the cylinder, the adjustment sleeve is fixedly mounted on a front end portion of the rotary housing, and the water duct, the nozzle, the limiting block, the adjustment member, each of the positioning posts, and each of the compression springs are all located in the rotary housing.

* * * * *